US005379575A

United States Patent [19]

Focke et al.

[11] Patent Number: 5,379,575

[45] Date of Patent: Jan. 10, 1995

[54] APPARATUS FOR INTRODUCING (SMALL) PACKS, ESPECIALLY CIGARETTE PACKS, INTO A BOX

[75] Inventors: Heinz Focke, Verden; Thomas Häfker, Etelsen, both of Germany

[73] Assignee: Focke & Co. (GmbH & Co.), Verden, Germany

[21] Appl. No.: 42,389

[22] Filed: Mar. 22, 1993

[30] Foreign Application Priority Data

Mar. 21, 1992 [DE] Germany ..... 4209246

[51] Int. Cl.[6] ..... B65B 5/06

[52] U.S. Cl. ..... 53/543; 53/246; 53/252; 53/258; 53/540

[58] Field of Search ..... 53/543, 540, 531, 252, 53/251, 250, 249, 263, 246, 247, 258, 255

[56] References Cited

U.S. PATENT DOCUMENTS

| | | | |
|---|---|---|---|
| 2,277,408 | 3/1942 | Molins et al. | 53/540 X |
| 2,681,171 | 6/1954 | Brown, Jr. et al. . | |
| 3,022,615 | 2/1962 | Schroeder et al. | 53/448 X |
| 3,479,795 | 11/1969 | Martin . | |
| 3,512,336 | 5/1970 | Rosecrans . | |
| 3,566,574 | 3/1971 | Salwasser . | |
| 3,655,180 | 4/1972 | Holler | 53/540 X |
| 3,748,797 | 7/1973 | Deins | 53/152 X |
| 4,281,499 | 8/1981 | Koshishiba et al. | 53/540 X |

FOREIGN PATENT DOCUMENTS

| | | |
|---|---|---|
| 36398 | 9/1981 | European Pat. Off. . |
| 1475781 | 4/1902 | France . |
| 110226 | 12/1974 | Germany . |
| 2519776 | 11/1976 | Germany . |
| 2096092 | 10/1982 | United Kingdom . |

*Primary Examiner*—James F. Coan

*Attorney, Agent, or Firm*—Sughrue, Mion, Zinn, Macpeak & Seas

[57] ABSTRACT

Disclosed is an apparatus for introducing (small) packs, especially cigarette packs, into a box. An intermediate container (18) is used in order to fill containers, especially boxes (16), with a plurality of (small) packs arranged in rows above and next to one another. This intermediate container is formed from elongated compartments (19) which are open at both ends and which receive one pack group (20) each. The intermediate container (18) is positioned in front of the open box (16) in such a way that the contents can be pushed into the box (18) in a single push-out cycle. A feed conveyor (28) which serves for filling the intermediate containers (18) feeds a pack string (15) from a packaging machine (11) to the intermediate container (18) and directly introduces the pack string into the compartments (19).

12 Claims, 4 Drawing Sheets

APPARATUS FOR INTRODUCING (SMALL) PACKS, ESPECIALLY CIGARETTE PACKS, INTO A BOX

BACKGROUND OF THE INVENTION

The invention relates to an apparatus for introducing (small) packs, especially cigarette packs, into a large container, preferably a box, whereby the cigarette packs are oriented within the box in rows or layers.

Cigarette packs are often sold in the form of a bundle, i.e. a so-called cigarette carton. Conventionally, such a bundle is formed from ten cigarette packs arranged in two superposed pack rows and enclosed in an outer wrapping made of paper or cardboard.

For certain channels of distribution, these bundles are not suitable, and it is required to introduce a relatively large number of cigarette packs directly into a large-volume container, especially a packing or transport box.

SUMMARY OF THE INVENTION

It is the object of the invention to propose an apparatus for mechanically filling cigarette packs or other packs into a large container, in which the packs are to be arranged and oriented in rows or layers.

To attain this object, the apparatus according to the invention is characterized in that the cigarette packs are conveyable in succession into an intermediate container having compartments holding several packs (pack group) each, and in that the compartments are arranged in rows next to one another and/or above another in response to the formation of the cigarette packs within the box, and in that the contents of some or all compartments are conveyable by a push-out means into the box which faces the intermediate container with an open side.

The intermediate container is preferably designed such that it can receive the entire load for the box, specifically in a relative arrangement of the packs which corresponds to that within the box. The entire contents of the intermediate container are emptied in one working cycle, such that the packs which are pushed out of the open compartments reach and fill the box immediately after they have left the intermediate container without any appreciable change of the relative position.

Alternatively, the intermediate container may be dimensioned such that only a part of its load is received in a—correspondingly smaller—box. In this case, two or more boxes can be filled with a partial load of the intermediate container.

The invention is also directed to the feeding of the cigarette packs, which usually come from a packaging machine, to the intermediate container. In accordance with the invention, a feed conveyor is provided for this purpose, which conveys the individual cigarette packs in succession in the form of a string of packs and, if required, with several cigarette packs lying on top of one another. These cigarette packs are directly introduced through an open side into the compartments of the intermediate container by the feed conveyor. According to the invention, the feed conveyor is movable, especially pivotable, so that the transfer end can move successively in front of each compartment of the intermediate container. Alternatively, the feed conveyor could be disposed in a fixed relative position, and the intermediate containers could be movable relative to this feed conveyor or its end in the horizontal and vertical direction, so that the open compartments are filled by the feed conveyor one after the other.

The dimensions of the intermediate container are preferably such that the contents of a conventional cigarette pack bundle are held in one compartment, i.e. altogether ten cigarette packs in two rows. The compartments are open on both sides, so that the pack group can be conveyed through the compartments in the longitudinal direction.

Further features of the invention relate to the structure of a filling station for the intermediate container and to details of a transfer station for transferring the packs to the container or box.

BRIEF DESCRIPTION OF THE DRAWINGS

An exemplary embodiment of the invention will be described hereinafter in detail with respect to the drawings, in which.

DETAILED DESCRIPTION OF THE PREFERRED EMBODIMENT

Figure 1:
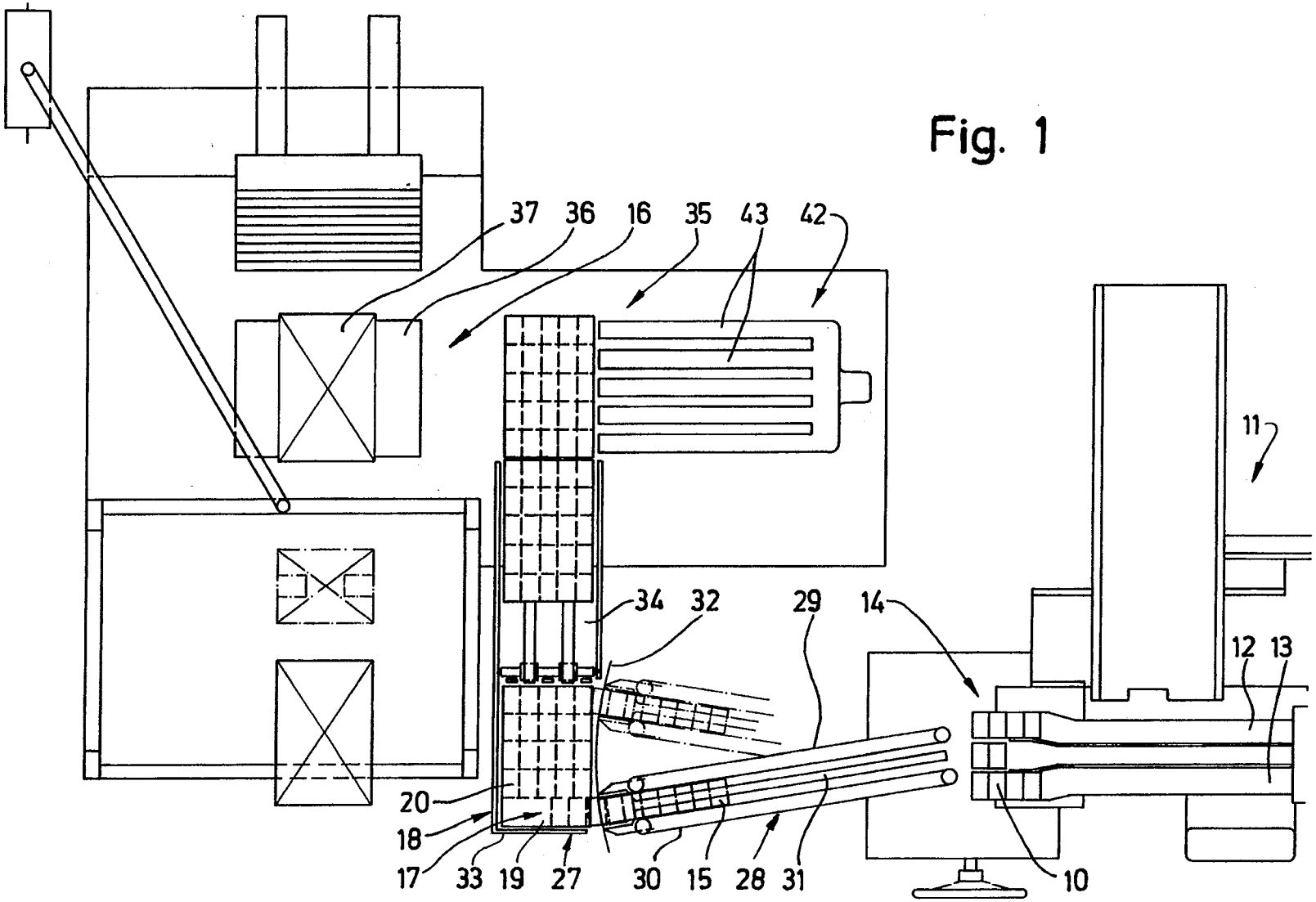
FIG. 1 shows a schematic plan view of an apparatus for filling (large) containers, in particular boxes.

The exemplary embodiment illustrated in the drawings is directed to the handling of cuboid (small) packs, namely cigarette packs 10. These packs are supplied by a packaging machine 11. In practice, this is a packaging machine 11 for an outer wrapping of the cigarette packs 10, in particular a cellophane or film wrapping.

Here, the packaging machine 11 is designed such that the cigarette packs 10 are manufactured in two tracks 12, 13. In the region of a transfer end of the tracks 12, 13, there is a collecting station 14, in which the cigarette packs 10 of the two tracks 12, 13 are brought together on a common track located centrally between the two tracks 12, 13. Each track 12, 13 delivers strings of packs in which two cigarette packs 10 are arranged on top of one another.

In the region of the collecting station 14, a continuous pack string 15 is formed which, in this case, consists of pairs of two superposed cigarette packs 10 as well.

The cigarette packs 10 are to be filled into a larger container, specifically into a box 16, without forming any further groups with wrappers (bundle). This box or carton has a conventional design and is made of corrugated cardboard. Within the box 16, the cigarette packs 10 are to be placed above one another in layers, each layer being formed from a plurality of side-by-side aligned pack rows 17.

The cigarette packs 10 are filled into a box 16 having at least one open side with the aid of an intermediate container 18 which is provided for a temporary accommodation of the contents of a box 16 in an orderly formation, and for the facilitated introduction of the appropriate number of cigarette packs 10 into the box 16.

The intermediate container 18 is formed from elongated compartments 19 which are open on both sides. The compartments 19 are rectangular in cross section and are dimensioned such that a pack group 20 of cigarette packs 10 fits in one compartment 19. In the described example, such a pack group 20 comprises altogether ten cigarette packs 10 which are disposed above one another in two pack rows 17. The cigarette packs 10 rest against one another with their large-surfaced pack sides (front side 21, rear side 22). Small end faces 23 and opposite bottom faces 24 extend in the longitudinal direction of the pack group 20. Accordingly, the cigarette packs 10 are directed with their longitudinal dimension transverse to the conveying direction, that is to say transverse to the pack string 15 and thus to the pack group 20.

The compartments 19 of the intermediate container 18 are defined by vertical walls 25 and horizontal walls 26. The free inner cross section of a compartment 19 corresponds to the cross section of a pack group 20. The longitudinal dimension of the compartment 19 is adapted to the dimension of a pack group 20 as well. The compartments 19 are oriented in (horizontal) layers and in rows, in accordance with the formation of the cigarette packs 10 in the box 16.

In the exemplary embodiment illustrated, the total volume of one intermediate container 18 corresponds to the contents of a box 16. However, it would also be possible that, in order to fill smaller containers or boxes, only a group of the compartments 19 receives the contents of one box. For example, an intermediate container 18 being twice the size of a box can be used to (simultaneously) fill two smaller boxes of appropriate size.

The intermediate containers 18 are filled with cigarette packs 10 in the region of a filling station 27. In the exemplary embodiment illustrated, the pack string 15 which is formed from pairs of two superposed cigarette packs 10 is conveyed into a compartment 19 until this compartment is full. For this purpose, a feed convey or 28 acts as a conveying connection between the packaging machine 11 and the filling station 27 or the intermediate container 18. In this case, the feed conveyor 28 is formed from two lateral conveyor belts 29, 30 and a carrying web 31 extending in the longitudinal direction. The pack string 15 rests on this carrier web during the preferably continuous transport. The feed conveyor 28 extends directly up to the inlet side of the compartments 19 of an intermediate container 18. The transport of the pack string 15 feeds it into the compartment 19 which is to be filled. The feed conveyor 28 is continuously supplied with cigarette packs 10 in the region of the collecting station 14.

In the exemplary embodiment described above, the feed conveyor 28 is movable, in particular pivotable in a horizontal plane. An (imaginary) fulcrum is located in the region of the collecting station 14. The free end of the blank conveyor 28 is movable along an arc of a circle 32.

As a result of this movement, the compartments 19 which are located in one plane or layer can be filled one after the other while the intermediate container 18 is stationary. In order to fill an intermediate container 18 completely, it is moved upwards layer by layer, so that the feed conveyor 28 is able to fill all compartments 19 in succession.

The filled intermediate container 18 is transported away from the filling station 27 in the transverse direction by a pusher 33, and is pushed onto a conveyor, in this case a belt conveyor 34. This belt conveyor transports the intermediate container 18 into a transfer station 35, in which the filled intermediate container 18 is positioned in such a way that the compartments 19 are directed towards an open box 16 with their open rear side. Now, the entire contents of the intermediate container 18 are conveyed out of the intermediate container and into the box 16 in a single working cycle.

In the exemplary embodiment described, the box 16 is positioned in the form of a casing being open on two sides. Folding tabs 36 for forming a bottom wall and top wall of the box 16 adjoin and extend the side walls 37 of the box 16. To facilitate the introduction of the cigarette packs 10, the open side of the box 16 faces a filler mouthpiece 38 which is formed from several lateral guiding pieces 39 which are disposed in the region of box edges. In a cross-sectional view of the filler mouth piece 38, these guiding pieces 39 diverge towards the intermediate container 18 in a funnel-like manner, so as to facilitate the introduction of the pack groups 20 which essentially fill out the cross section of the box 37. In the exemplary embodiment described, a further guiding means 40 is disposed between the filler mouthpiece 38 and the intermediate container 18 and is formed from lateral upper and lower guiding plates 41 which are also arranged in a slightly funnel-shaped manner.

The contents of the intermediate container 18 are pushed out the compartments 19 with a push-out means 42 and are conveyed directly into the final position within the box 16. For this purpose, the push-out means 42 is provided with as many elongated plungers 43 as there are compartments 19. The plungers 43 are arranged in the same formation as the compartments 19. Each compartment 19 is associated with a plunger 43. The cross section of the plunger 43 is slightly smaller than that of the compartments 19, so that the cigarette packs 10 are engaged reliably.

In the exemplary embodiment described, a counter holder 44 acts, during the introduction of packs into the box 16, upon the cigarette packs 10 on that side of the cigarette packs 10 which is located opposite the push-out means 42. This counter holder 44 is provided with a supporting plate 45 which rests with a free side against the cigarette packs 10 which exit the intermediate container 18. The counter holder 44 exerts a certain counter pressure which ensures that the formation of the cigarette packs is maintained until they have reached the final position within the box 16. The counter holder 44 is operated by a slide rod 46 and enters the box 16 through the open side of the box which is located opposite the filler mouthpiece 38. As soon as the cigarette packs 10 contact the supporting plate 45 during the push-out movement, the counter holder 44 is moved back synchronously with the movement of the push-out means 42.

As a result of the guiding means 40 which converges in the direction of movement of the cigarette packs 10, and as a result of the correspondingly designed filler mouthpiece 38, the cigarette packs 10 are pushed together tightly as they pass through the channel defined by the vertical walls 25 and horizontal walls 26.

Figure 2:
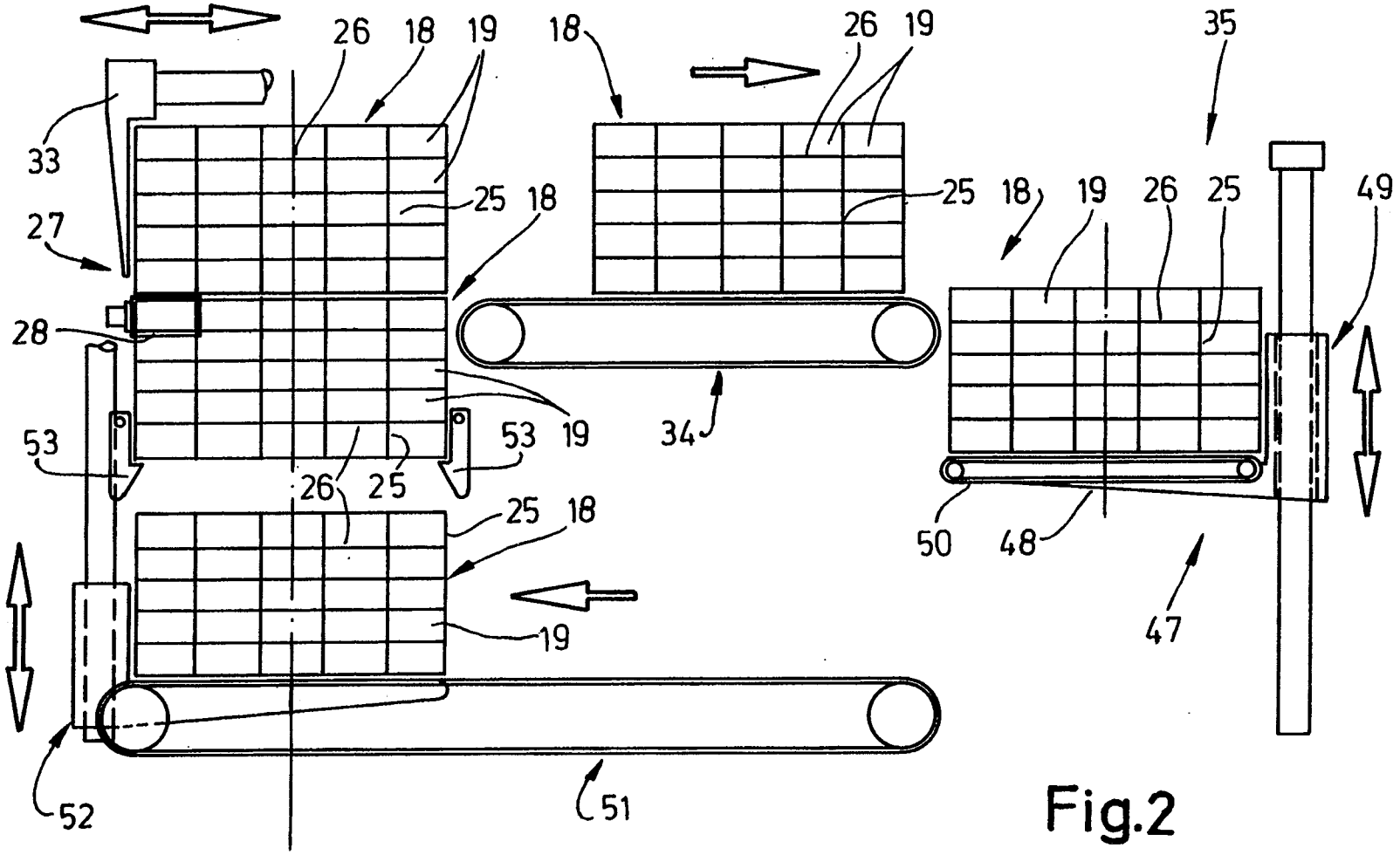
FIG. 2 shows a side view of part of the apparatus of FIG. 1, on an enlarged scale.
Figure 3:
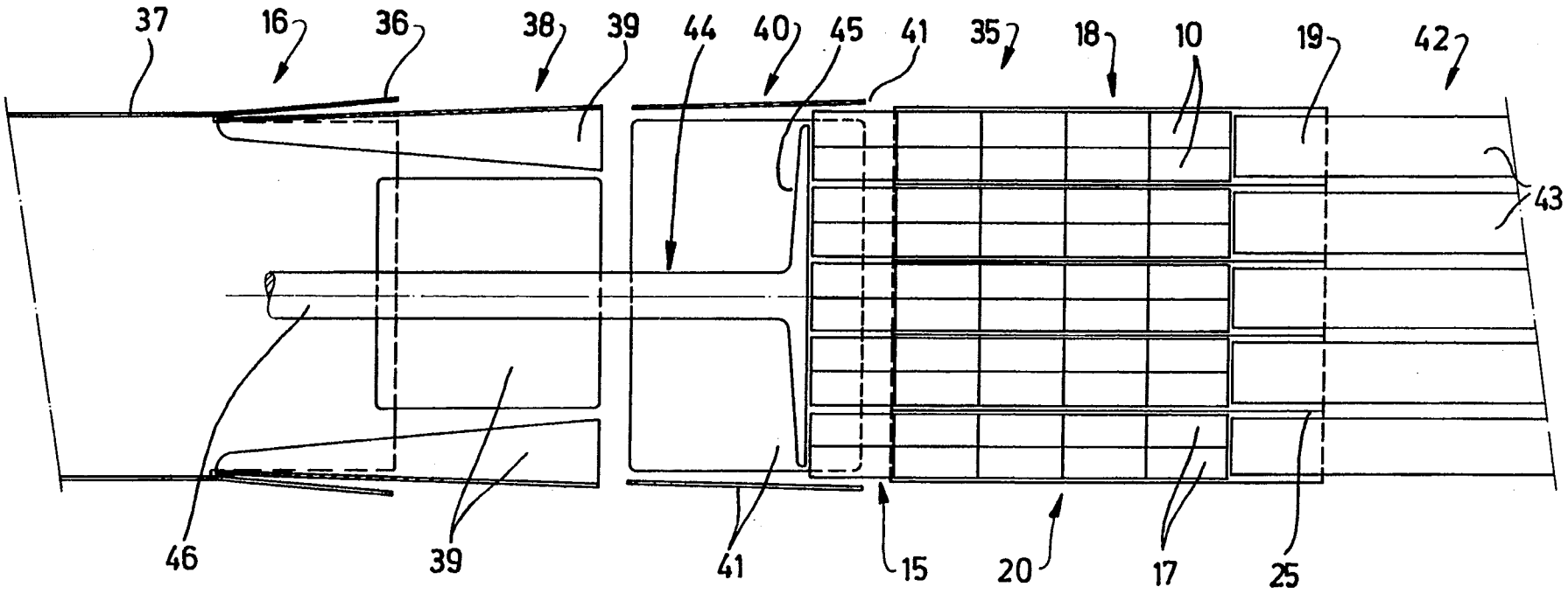
FIG. 3 shows a plan view of another detail of the apparatus of FIG. 1, in particular a transfer station.
Figure 4:
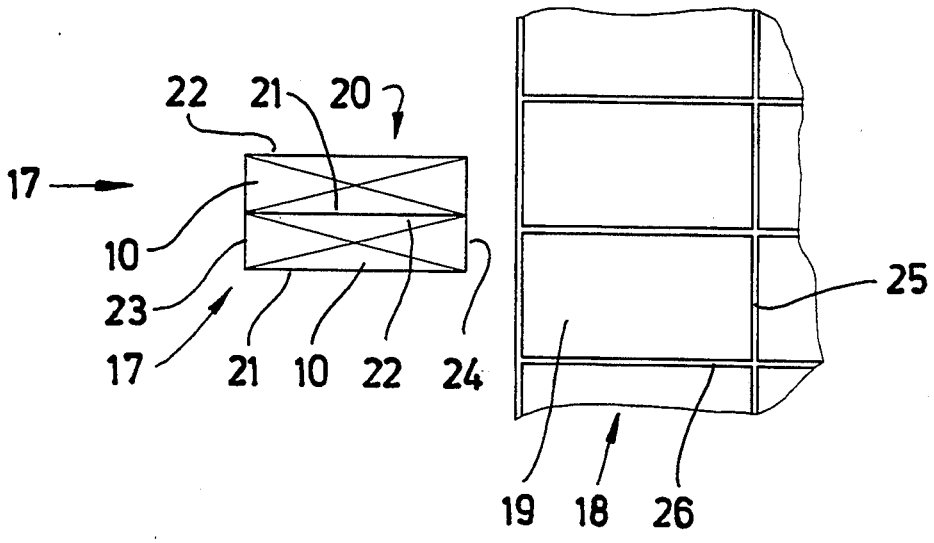
FIG. 4 shows a detail of an intermediate container, on a greatly englarged scale.

According to the invention, a plurality of intermediate containers 18 is conveyed in a cycle. The filled intermediate container 18 is transferred by the belt conveyor 34 to a carrier 47 in the region of the transfer station 35. The carrier 47 is provided with a supporting leg 48 for receiving the intermediate container 18. The supporting leg 48 forms part of a lifting means 49 which is movable up and down. Endless conveyors 50 which are located on the supporting leg 48 move the intermediate container 18 into the correct position. FIG. 2 shows the position of the intermediate container 18 in which the cigarette packs 10 are pushed out. Accordingly, this push-out position is located below the plane of the belt conveyor 34.

After the intermediate container 18 has been emptied, it is lowered further by the lifting means 49 down to the plane of a return conveyor 51 which transports the empty intermediate containers 18 back into the filling station 27.

The filling station 27 is also designed in a special way. A vertical conveyor 52 lifts the empty intermediate containers 18 off the return conveyor 51 and transports them with an upward movement to the loading plane. This upward movement is conducted in a step-like fashion in response to the process of filling the layers of the compartments 19. For this purpose, one intermediate container 18 is moved against the underside of an intermediate container 18 located in the filling position. The further step-like upward movement in response to the filling process is effected by the intermediate container 18 located thereunder by means of an appropriate upward movement of the vertical conveyor 52. When the respective intermediate container 18 has been filled completely, it is lifted up to the level of the belt conveyor 34 and transported away by the pusher 33. At the same time, the intermediate container 18 located thereunder reaches the filling position. Immediately thereafter, the vertical conveyor 52 returns to the lower position in order to receive a further intermediate container 18. In the meantime, the intermediate container 18 is held in the filling position by means of supporting pawls 53 which are automatically disengaged when the next intermediate container 18 is supplied from below.

The boxes 16 which are filled in the way described above are closed by folding the folding tabs 36 and are then discharged.

We claim:

1. In an apparatus for introducing cigarette packs (10) into one or more boxes (16), so that, the cigarette packs (10) are oriented in rows and layers within each box (16), the improvement comprising:

a) means (28) for conveying the cigarette packs (10) in succession into an intermediate container (18), so that the total number of the cigarette packs (10) which are conveyed into said intermediate container (18) corresponds to the contents of at least one of said boxes (16);

b) wherein the intermediate container (18) has a plurality of compartments (19), each for accommodating a pack group (20) formed from a plurality of cigarette packs (10), said compartments (19) being arranged next to one another and above one another inside of the box (16), in accordance with the formed group of the cigarette packs (10);

c) wherein the compartments (19) are defined by vertical walls (25) and horizontal walls (26), and are open at both ends;

d) wherein a free inner cross-section and a length of each compartment (19) respectively correspond to a cross-section and a length of the pack group (20);

e) wherein said conveying means (28) conveys the cigarette packs (10) into the compartments (19) in a longitudinal direction of said packs which are pushable out of each compartment (19) as a pack group (20); and further comprising f) push-out means (42) having plungers (43), which pass through the compartments in the longitudinal direction, for pushing out the contents of the compartments (19), assigned to a box (16), in a single working cycle into the assigned box (16) which faces the intermediate container (18) with an open side.

2. The apparatus as claimed in claim 1, wherein a counter holder (44) is arranged on the side of the intermediate container (18) opposing the push-out means (42), and said counter holder (44) has a holding plate (45) which, during the filling of the box (16), adjoins the cigarette packs (10) exiting from the intermediate container (18).

3. The apparatus as claimed in claim 1, wherein the compartments (19) are dimensioned such that they hold a pack group (20) of two pack rows (17) disposed above one another, and wherein cuboid cigarette packs (10) are directed with their longitudinal dimension transverse to the longitudinal dimension of the compartments (19).

4. The apparatus as claimed in claim 1, wherein said feeding means (28) conveys a continuous pack string (15), corresponding to a filling cross section of each of the compartments (19), into the compartments (19) in succession until the compartments are filled.

5. The apparatus as claimed in claim 4, wherein said feeding means is a feed conveyor (28) which opens out in front of a respective compartment (19) which is to be filled.

6. The apparatus as claimed in claim 5, further comprising means for moving the intermediate container (18) and the feed conveyor (28) relative to one another at least in the region of a feed outlet of the feed conveyor (28), in order to fill the compartments (19) in succession.

7. The apparatus as claimed in claim 6, wherein the feed conveyor (28) is movable relative to the intermediate container (18), by pivoting in a horizontal plane in order to fill compartments (19) which are arranged in one plane next to one another.

8. The apparatus as claimed in claim 6, wherein the intermediate container (18) is movable intermittently relative to the teed outlet of the feed container (28) in the horizontal and a vertical direction.

9. The apparatus according to claim 1, further comprising a filler mouthpiece (38), which has funnel-shaped guiding pieces (39) diverging towards the intermediate container (18), arranged in an accurate position between the box and the intermediate container (18) during the filling of the box.

10. The apparatus as claimed in claim 1, further comprising means for transversely feeding a filled intermediate container (18) from a filling station (27) to a transfer station (35) in which the intermediate container (18) is positioned accurately relative to an open box (16).

11. The apparatus as claimed in claim 10, further comprising means for conveying the intermediate containers (18) in the filling station (27) from below in succession to a filling position, whereby the respective intermediate container (18), which is located in the filling position, is lifted intermittently in accordance with the filling thereof by an intermediate container (18) located thereunder.

12. The apparatus as claimed in claim 11, further comprising a return conveyor (51) for feeding emptied intermediate containers (18) to the filling station (27), said return conveyor (51) extending below the filling position, and vertical conveyor means (52) for lifting the emptied containers in succession to the level of the filling position.

* * * * *